United States Patent [19]

Daudi

[11] Patent Number: 4,646,434

[45] Date of Patent: Mar. 3, 1987

[54] APPARATUS FOR WHEEL MANUFACTURE FOR CORRECTION OF ROTATIONAL NON-UNIFORMITY OF A PNEUMATIC TIRE AND WHEEL ASSEMBLY

[75] Inventor: Anwar R. Daudi, E. Lansing, Mich.

[73] Assignee: Motor Wheel Corporation, Lansing, Mich.

[21] Appl. No.: 707,137

[22] Filed: Mar. 1, 1985

[51] Int. Cl.[4] ..... B23P 19/00; B21H 1/02

[52] U.S. Cl. ..... 29/802; 29/159.01

[58] Field of Search ..... 29/159, 159.1, 407, 29/802; 72/326

[56] References Cited

U.S. PATENT DOCUMENTS

| | | | |
|---|---|---|---|
| 3,143,377 | 8/1964 | Bulgrin et al. | 301/63 |
| 3,195,491 | 7/1965 | Bulgrin et al. | 29/159.01 |
| 3,222,765 | 12/1965 | Parent et al. | 29/159.01 |
| 3,530,717 | 9/1970 | Gregg | 72/354 |
| 3,688,373 | 9/1972 | Gregg | 29/159.01 |
| 3,800,600 | 4/1974 | Chapin | 29/159.01 |
| 3,855,683 | 12/1974 | Philipp | 29/159.01 |
| 4,074,408 | 2/1978 | Davis | 29/802 |
| 4,106,172 | 8/1978 | Bache | 29/159.01 |
| 4,143,449 | 3/1979 | Main et al. | 29/159.1 |
| 4,279,287 | 7/1981 | Daudi et al. | 29/159.1 |
| 4,304,034 | 12/1981 | Trevarrow | 29/159.01 |
| 4,354,407 | 10/1982 | Daudi et al. | 83/55 |

*Primary Examiner*—Howard N. Goldberg

*Assistant Examiner*—Steven Nichols

*Attorney, Agent, or Firm*—Barnes, Kisselle, Raisch, Choate, Whittemore & Hulbert

[57] ABSTRACT

Apparatus for manufacturing a vehicle wheel rim and disc assembly with controlled lateral runout characteristics. The apparatus of the invention contemplate fixturing of a preformed rim so that the average plane of the rim bead seats is at preselected orientation with respect to the axis of interference press-fit of a preformed disc therein, and thus at preselected orientation with respect to the wheel mounting plane defined by the inboard disc surface. In one implementation of the invention, the average bead seat plane is made nominally parallel to the wheel mounting plane by selective adjustment of the fixturing bead seat locators, so as to minimize lateral runout of the resulting wheel. In another implementation of the invention, the average bead seat plane is intentionally angulated with respect to the disc mounting plane so as to locate a peak of the first harmonic of lateral runout circumferentially adjacent to a selected location on the wheel rim, such as the rim valve hole. In the latter implementation, the wheel so formed may be assembled to a pneumatic tire which is pretested and marked to identify location of a complementary peak of the first harmonic of lateral force variation, so that the respective harmonics are out of phase and tend to cancel each other, and thereby obtain overall improved ride in the tire and wheel assembly.

8 Claims, 10 Drawing Figures

50
56
116
120
130
138
132
24
34
122
154
140
150
142
158
62
66
52
18
81
22
128
102
20
82
136
134
110
182
178
160
184
180
88
92
60
70
94
76
80

50
56
116
120
126
4
158
154
140
142
150
138
122
128
24
34
130
132
18
20
81
22
62
66
52
136
134
54A
82
102
182
180
110
184
178
177
160
92
88
96
94
76
80

APPARATUS FOR WHEEL MANUFACTURE FOR CORRECTION OF ROTATIONAL NON-UNIFORMITY OF A PNEUMATIC TIRE AND WHEEL ASSEMBLY

The present invention relates to the art of vehicle wheel manufacture, and more particularly to correction of variations in lateral runout and/or lateral forces in a rotating pneumatic tire and wheel assembly.

BACKGROUND OF THE INVENTION

A problem long-standing in the art lies in the production of pneumatic tire and wheel assemblies which, when assembled and operated on a vehicle, run true about the axis of rotation. Forces generated by any circumferential variations in the tire carcass or wheel cause vibrations, which in turn lead to dissatisfied customers and significant warranty claims against automobile manufacturers. The present trend among manufacturers toward higher tire inflation pressures and smaller vehicles to improve fuel economy accentuates this problem, so that rotational uniformity of the tire and wheel assembly has become more critical than in the past.

Rotational non-uniformities in the tire and wheel assembly may possess both radial and axial components. Either or both of such components may be due to manufacturing inaccuracies in the wheel and/or in the tire mounted thereon. Axial characteristics, i.e. runout or force variations in the direction of the wheel and tire axis, are termed "lateral" characteristics in the art and in the present application.

Multipiece vehicle wheels fabricated from metal, usually steel, conventionally include a disc having a circular array of bolt openings adapted to receive mounting studs for mounting the wheel to a vehicle, and a center pilot opening adapted to be received over the wheel hub. In order to improve radial runout characteristics of the wheel, it has been and remains conventional practice in the wheel manufacturing industry to attempt to form the circle of bolt-mounting openings and the center-pilot opening coaxially with each other and with the rim tire bead seats, with the goal thus being to form a true-running wheel. A number of techniques have been proposed for accomplishing this result, including formation of the bolt and center openings with a single tool while locating off of the bead seats, machining the center opening while locating off of preformed bolt-mounting openings, and circumferentially permanently deforming the rim bead seats while locating off of the bolt-mounting and/or center-pilot openings.

U.S. Pat. Nos. 4,279,287 and 4,354,407, both assigned to the assignee hereof, depart from this conventional practice, and address the problem of radial runout and radial force variations in a pneumatic tire and wheel assembly by intentionally forming the bolt-mounting and/or center-pilot openings in the wheel disc at the time of wheel manufacture on an axis which is eccentrically offset from the average axis of the rim bead seats. Such radial offset is in a direction and amount which is predetermined to locate the low point or high point of the first harmonic of bead seat radial runout circumferentially adjacent to a selected location on the wheel rim, such as the rim valve hole. A pretested tire, having the location of the complementary peak of the first harmonic of radial force variation marked thereon, may then be assembled onto the wheel such that the respective tire and wheel harmonics are complementary and thereby tend to cancel each other. U.S. application Ser. No. 667,338, filed Nov. 1, 1984 by the inventor herein and assigned to the assignee hereof, discloses an improved technique for forming the bolt-mounting and center-pilot openings in either conventional or styled wheels, which technique may be employed for manufacture of either truerunning wheels with minimum radial runout or wheels of controlled eccentricity per the aforementioned patents.

It likewise has been and remains conventional practice in the wheel manufacturing industry to attempt to form true-running wheels of minimum lateral runout - i.e. wherein the mounting plane defined by the inboard surface of the wheel disc in the region of the bolt-mounting openings is parallel to the average plane of the rim bead seats. This is accomplished in accordance with the technique disclosed in Bulgrin et al U.S. Pat. No. 3,143,377, for example, by fixturing a preformed rim on a stationary annular die ring and then press-fitting a preformed disc into the rim, with the axis of press-fit being coincident with the axis of the rimfixturing ring. Problems with the technique so disclosed are that it does not directly or inferentially employ the average bead seat plane for purposes of fixturing the preformed rim, and that it does not readily accommodate adjustment for different manufacturing runs which may, and usually do, result in differing manufacturing tolerance variations in the rim and disc.

OBJECTS AND SUMMARY OF THE INVENTION

It is therefore a general object of the present invention to provide a method of manufacturing a vehicle wheel of the described type wherein the plane of the wheel mounting surface on the disc is accurately and adjustably positioned with respect to the average bead seat plane, as well as to provide an apparatus for performing such method, a wheel resulting from implementation thereof, and a pneumatic tire and wheel assembly which embodies improved ride characterstics resulting from use of such wheel.

A further and yet more specific object of the invention is to provide an economical and accurate method of assembling a pre-formed wheel disc to a pre-formed rim wherein the plane of the disc mounting surface is accurately located with respect to the average plane of the rim bead seats, and to provide an apparatus for performing such method and a wheel resulting from application thereof.

A further object of the inention is to provide a wheel manufacturing method and apparatus which accomplishes the foregoing and which is economical to implement in mass product of vehicle wheels.

It is yet another object of the invention to provide a method and apparatus of the described character wherein the plane of the disc mounting surface and the average plane of the rim bead seats are all adjustable with respect to each other, so that the method and apparatus of the invention may be implemented in manufacture of true-running wheels wherein the mounting plane and the average bead seat plane are nominally parallel, or in the manufacture of wheels in accordance with another aspect of the invention wherein the low point or high point of the first harmonic of average bead seat lateral runout (with respect to the mounting plane) is angulated by an amount and in a direction predetermined to locate such low point or high point of the first harmonic of bead seat lateral runout circumferentially adjacent to a selected location on the wheel rim, most preferably the rim valve opening.

A still further object of the invention thus contemplates provision of a pneumatic tire and wheel assembly which obtains improved ride characteristics by "match mounting" a wheel having controlled lateral runout per the foregoing object with a pneumatic tire pretested and having the complementary peak of the first harmonic of lateral force variation marked thereon, so that such lateral runout and lateral force variation harmonics tend to cancel each other.

In general, the foregoing and other objects are obtained in accordance with one important aspect of the present invention by fixturing a preformed rim locating off of the rim bead seat region so that the rim is held in stationary position with the average plane of the bead seat region at predetermined orientation. A preformed disc is then interference press-fitted into the rim so that the disc mounting plane is accurately located with respect to the average bead seat plane. The apparatus for performing this method in accordance with another aspect of the invention includes a circumferential array of bead seat locating jaws which are individually adjustable axially of such array for selective orientation of the average bead seat plane of a preformed wheel rim resting thereon. Most preferably, the bead seat locating jaws include sections for locating both the inboard and outboard bead seat regions of a one-piece rim for a pneumatic tubeless tire, such that the average plane of the bead seat regions is located more accurately and the rim is more fixedly held during the press-fit operation.

In one preferred implementation of the invention, the bead seat locators are adjusted during a setup operation so that the mounting plane of the wheel disc pressed into a rim held by the bead seat locators is nominally parallel to the average bead seat plane, so that the resulting wheel is substantially true-running in lateral characteristics. In another implementation of the invention, the bead seat locators are adjusted during a setup operation so that the average bead seat plane is intentionally angulated with respect to the disc mounting plane by an amount and in a direction empirically selected to a place a peak of the first harmonic of lateral runout adjacent to a preselected circumferential location on the wheel rim, such as the rim valve hole. Such wheels, having controlled lateral eccentricity, may then be mounted to pretested tires so that the lateral characteristcs thereof tend to cancel.

Althought the preformed discs employed in accordance with the present invention may have bolt-mounting and center-pilot openings already formed therein as disclosed in the above-reference Bulgrin et al patent, it is preferred that such openings be formed at a later stage of manufacture in the rim and disc assembly in accordance with the teachings of one or more of the U.S. patents and applications noted above and assigned to the assignee hereof.

BRIEF DESCRIPTION OF THE DRAWINGS

The invention, together with additional objects, features and advantages thereof, will be best understood from the following detailed description, the appended claims and the accompanying drawings in which:

DETAILED DESCRIPTION OF PREFERRED EMBODIMENTS

Figure 1:
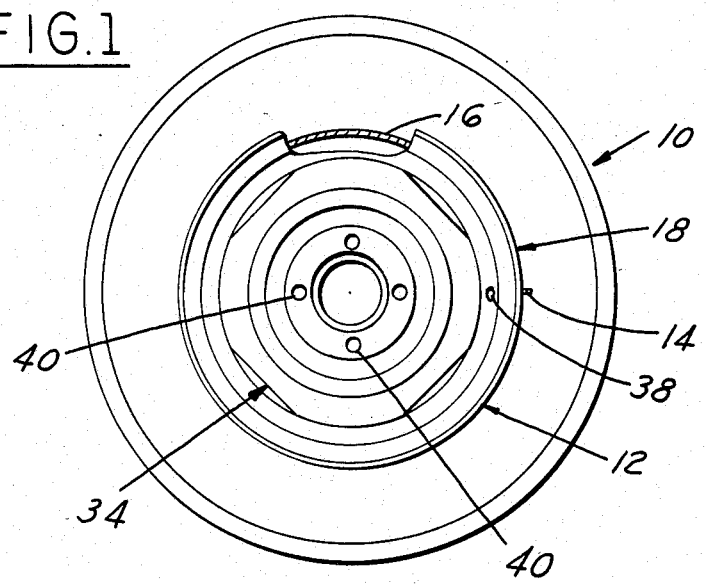
FIG. 1 is a partially sectioned outboard elevational view of a vehicle pneumatic tire and wheel assembly in accordance with one aspect of the invention.
Figure 2:
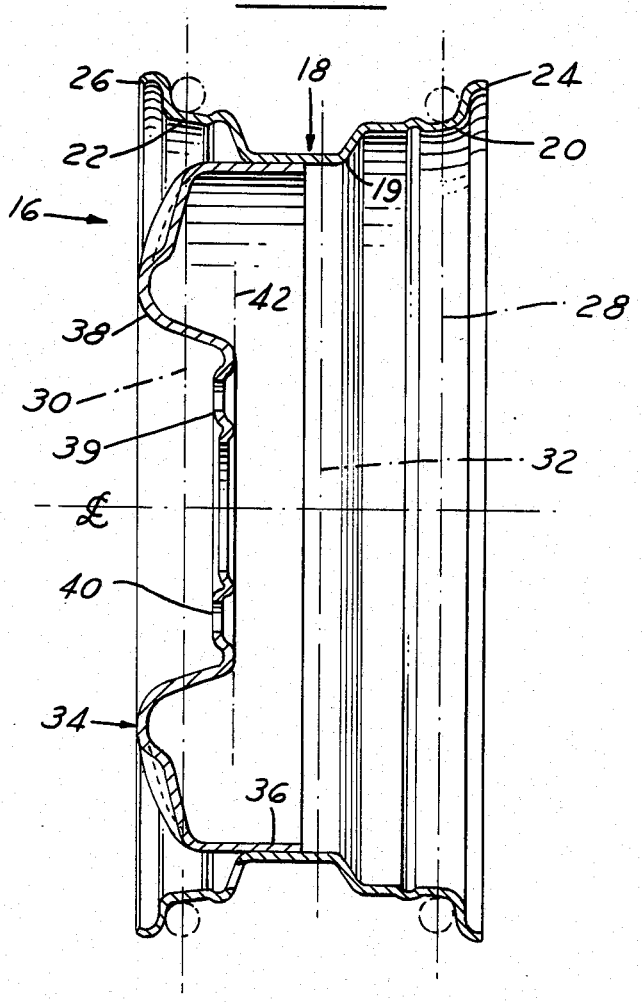
FIG. 2 is a sectioanl view of the wheel of FIG. 1 taken in a radial plane which intersects the wheel axis.
Figure 3:
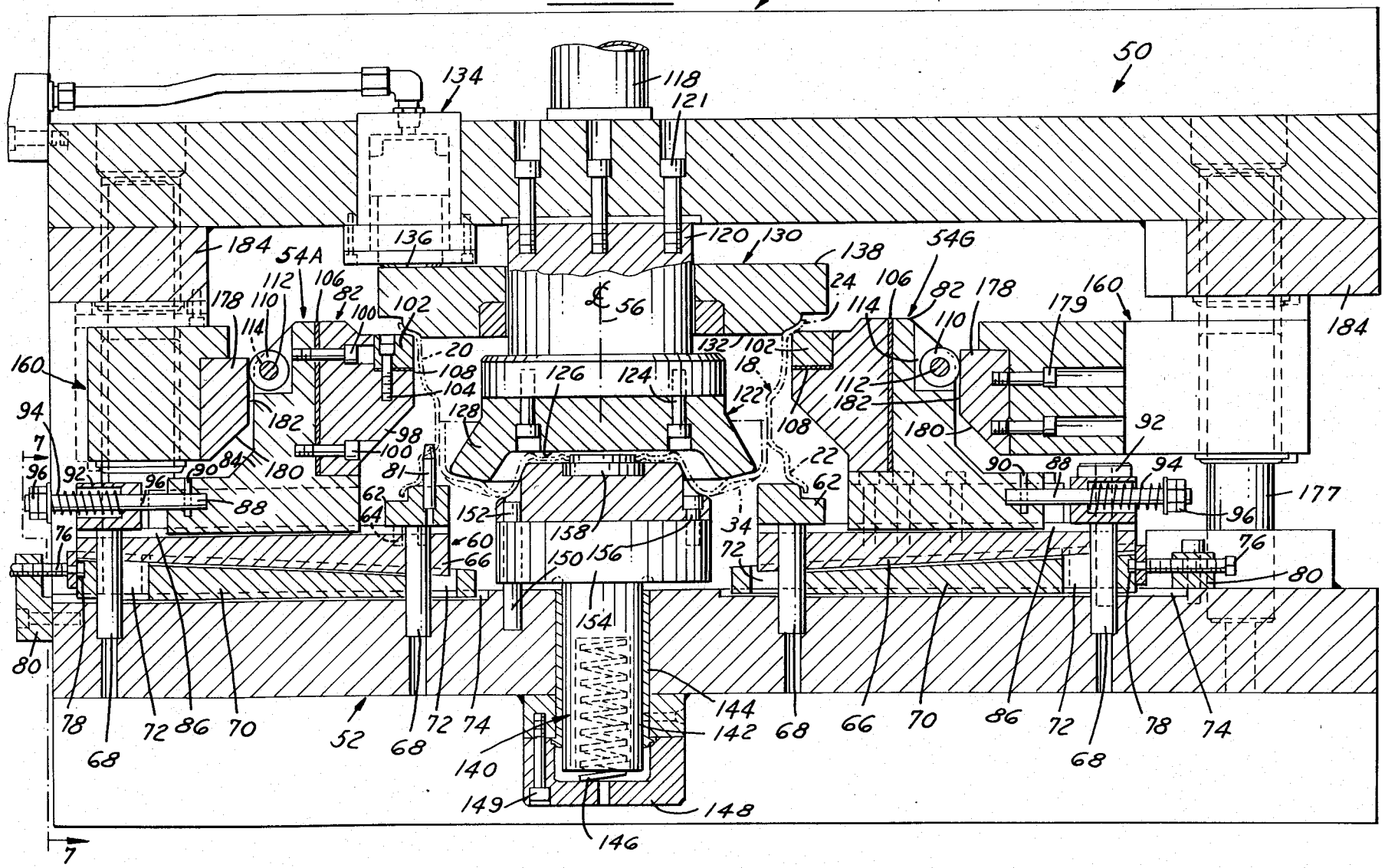
FIG. 3 is a sectional view in side elevation of a presently preferred embodiment of the wheel manufacturing apparatus in accordance with another aspect of the present invention.

FIG. 1 illustrates a pneumatic tire and wheel assembly 10 as comprising a conventional tubeless pneumatic tire 12 mounted on a two-piece fabricated steel wheel 16. Referring to FIGS. 1 and 2, wheel 16 includes a one-piece drop center wheel rim 18 having a rim base 19 and inboard and outboard circumferential bead seat regions 20 and 22 for receiving respective inboard and outboard bead toes of tire 12 in the usual manner. Bead seat regions 20,22 include the usual bead retaining flanges 24,26 respectively. Each bead seat region 20,22 may be considered conceptually to lie in or define an associated bead seat plane 28,30 (FIG. 2) which in theory are planar and parallel to each other but may not be planar or parallel in practice due to manufacturing variations and tolerances. Bead seat planes 28,30 together define an average bead seat plane illustrated at 32. The individual (average) bead seat planes 28,30, as well as the location and orientation of the average plane 32 of the two bead seats, may be located using conventional Fourier analysis techniques. A wheel mounting disc 34 includes a peripheral flange 36 press-fitted into and welded to rim base 19, and a disc body 38 which internally spans rim 18 for mounting wheel 16 to a vehicle. Bolt openings 40 are formed in a circular array, one in each of the slightly raised bolt-hole islands 39 (FIG. 2). The inboard surface of disc body 38 in the region of bolt openings 40 defines a wheel mounting surface having the average plane 42, which engages the wheel mounting spindle when the wheel is bolted thereto.

As is understood in the art, the relationship of bead seat planes 28,30 to each other and to disc mounting plane 42 controls lateral runout characteristics of wheel 16. The relationship of bead seat planes 28,30 to each other is determined during preforming the rim. The present invention addresses the relationship of disc mounting plane 42 to bead seat planes 28,30. It has become conventional practice in recent years to preform rim 18 and disc 34, with the configuration of FIG. 2 being exemplary, and to join the rim to the disc prior to formation of the bolt-mounting and center-pilot openings in the disc body. Indeed, the U.S. patents and patent application assigned to the assignee hereof and identified hereinabove disclosure methods and apparatus for forming such bolt-mounting and center-pilot openings in a preassembled rim and disc. The present invention is directed to assembly of a preformed disc 34 to a preformed rim 38, preferably prior to formation of the bolt-mounting and center-pilot openings in the disc body in accordance with teachings of the above-referenced U.S. patents and application. It will be understood, however, that it is within the scope of the invention to employ a disc body having the bolt-mounting and center-pilot openings formed therein prior to assembly to the rim.

FIGS. 3-7 collectively illustrate an exemplary but preferred press apparatus 50 constructed in accordance with the present invention for press-fitting a preformed disc 34 into a preformed rim 18. Apparatus 50 includes a fixed support base or platform 52. A circumferential array 54 of twelve bead seat locators 54A-54L are arrayed on platform 52 at equal angular increments around the central axis 56 (FIGS. 3-4) of apparatus 50. Bead seat locators 54A-54L are of generally identical construction. Locator 54A will be described in detail. Corresponding elements of the remaining locators, where illustrated in the drawings, are identified by correspondingly identical reference numerals.

Bead seat locator 54A includes a lower first locator section 60 (FIG. 3) which, in combination with the first section of the remaining locators 54B-54L, collectively engage and fixture the outboard bead seat region 22 of wheel rim 18. (It will be understood that the term "bead seat region" is employed in a general sense and includes at least that portion of the bead retaining flange contiguous with the bead seat.) Bead seat locator section 60 includes a locator pad 61 having an upper surface contoured to engage bead seat region 22, and a lower surface affixed by bolts 64 to an upper wedge block 66. Upper wedge block 66 is maintained in fixed position radially of axis 56 by the radially spaced pins 68 which depend from block 66 and are slidably received into corresponding locator bores on support platform 52. Upper wedge block 66 has an angulated inclined lower surface which is slidably carried on a complementarily angulated inclined upper surface of a lower wedge block 70. Lower wedge block 70 has slotted apertures 72 through which pins 68 extend, and is itself slidably received in a radially oriented guideway or slot 74 on base 52. Thus, lower wedge block 70 is restrained by pins 68 and guideway 74 to radial motion with respect to axis 56, and upper wedge block 66 is restrained by pins 68 to axial motion parallel to axis 56 as a function of radial motion of lower wedge block 70. A threaded stud 76 (FIGS. 3 and 7) has a head 78 rotatably carried at the radially outer end of lower wedge block 70 and projects radially outwardly therefrom through a threaded opening in a block 80 affixed to support base 52. Thus, stud 76 adjusts radial position of lower wedge block 70, which in turn adjusts axial position of upper wedge block 66 and pad 62 relative to central axis 56. A pin 81 (FIGS. 3-4) projects upwardly from pad 62 of locator 54A (but not locators 54B-54L) parallel to axis 56 for receipt into the preformed valve hole 38 on rim 18, thereby accurately and repeatably locating each rim angularly of axis 56.

Figure 7:
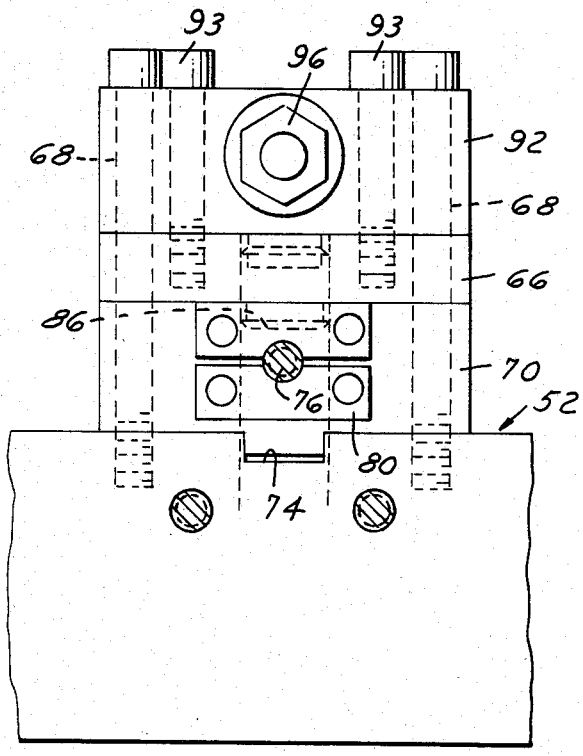
FIG. 7 is a fragmentary sectional view taken substantially along the line 7—7 in FIG. 3.

Bead seat locator 54A further includes a second locator section 82 which, in cooperation with the corresponding second sections of bead seat locators 54B-54L, collectively engage and fixture the inboard bead seat region 20 of wheel rim 18. Locator section 82 includes a base 84 slidably carried in a radial slot 86 on the upper surface of upper wedge block 66. Slot 86 thus forms a guideway for motion of base 84 in the radial direction relative to axis 56. A shaft 88 is affixed by the pin 90 (FIG. 3) to base 84 and projects radially outwardly therefrom slidably through a spring block 92 affixed to the upper surface of wedge block 66 by the bolts 93 (FIG. 7). A coil spring 94 is captured in compression between block 92 and the jam nuts 96 threaded onto the radially outer end of shaft 88 for normally biasing base 84 radially outwardly with respect to axis 56. A pad adapter 98 is affixed to base 84 by the bolts 100 and projects radially inwardly therefrom. An inboard bead seat locator pad 102 is mounted on an axially facing ledge of adapter 98 by the bolt 104. Shim pieces 106,108 respectively separate adapter 98 from base 84 and pad 102 from adapter 98 for adjusting the radial and axial positions of pad 102 respectively. The upper radially inner edge of pad 102 is adapted for facing engagement with inboard bead seat region 20 of wheel 18. A cam roller 110 is rotatable on a shaft 112 within a slot 114 adjacent to the upper radially outer edge of base 84.

An upper die holder 116 (FIG. 3) is coupled to a controlled hydraulic ram 118 for reciprocal motion in the direction of axis 56. An upper press die head 120 is affixed by bolts 121 to and depends from holder 116 coaxially with axis 56. A die pressure plate 122 is coaxially affixed to die head 120 by the bolts 124 and has a planar lower surface 126 accurately positioned perpendicular to axis 56. An annular outwardly flaring horn 128 surrounds planar die plate surface 126 and is contoured to engage and support the midportion of disc 34 when the inboard mounting surface thereof is pressed against planar surface 126. A pressure ring 130 surrounds and is slidably carried on the radially facing surface of die head 120 for axial motion with respect thereto. The lower surface 132 of pressure ring 130 is contoured to engage the inboard bead retaining flange 24 of rim 18 and thereby hold inboard bead seat region 20 in accurate position against the bead seat locators 54A-54L. A circumferential array of hydraulic springs 134 is carried by holder 116 and have actuators 136 which depend therefrom in position to engage and exert uniform axial pressure upon the planar upper surface 138 of pressure ring 130.

A lower die head 140 (FIGS. 3-4) is mounted on base 52 for reciprocation in the direction of axis 56. Die head 140 includes a hollow shaft 142 (FIG. 3) which projects downwardly through a sleeve bearing 144 in base 52 coaxially with axis 56. A coil spring 146 is captured in compression within shaft 142 and engages the bottom wall of a cup 148 affixed by bolts 149 to base 52 for normally biasing lower die head 140 upwardly with respect to the support base. Reciprocal motion of die head 140 with respect to base 52 is guided by a circumferential array of pins 150 carried by base 52 and slidable within corresponding bores 152 in die head 140, only one such pin being illustrated in FIG. 3. A lower die pressure plate 154 is affixed by the bolts 156 to lower die head 140 and has an upper surface contoured to engage the outboard face of disc 34. An oval hub 158 projects centrally upwardly from pressure plate 154 and is received within a corresponding oval opening in preformed disc 34 for locating the disc bolt-hole islands angularly of axis 56.

Figure 4:
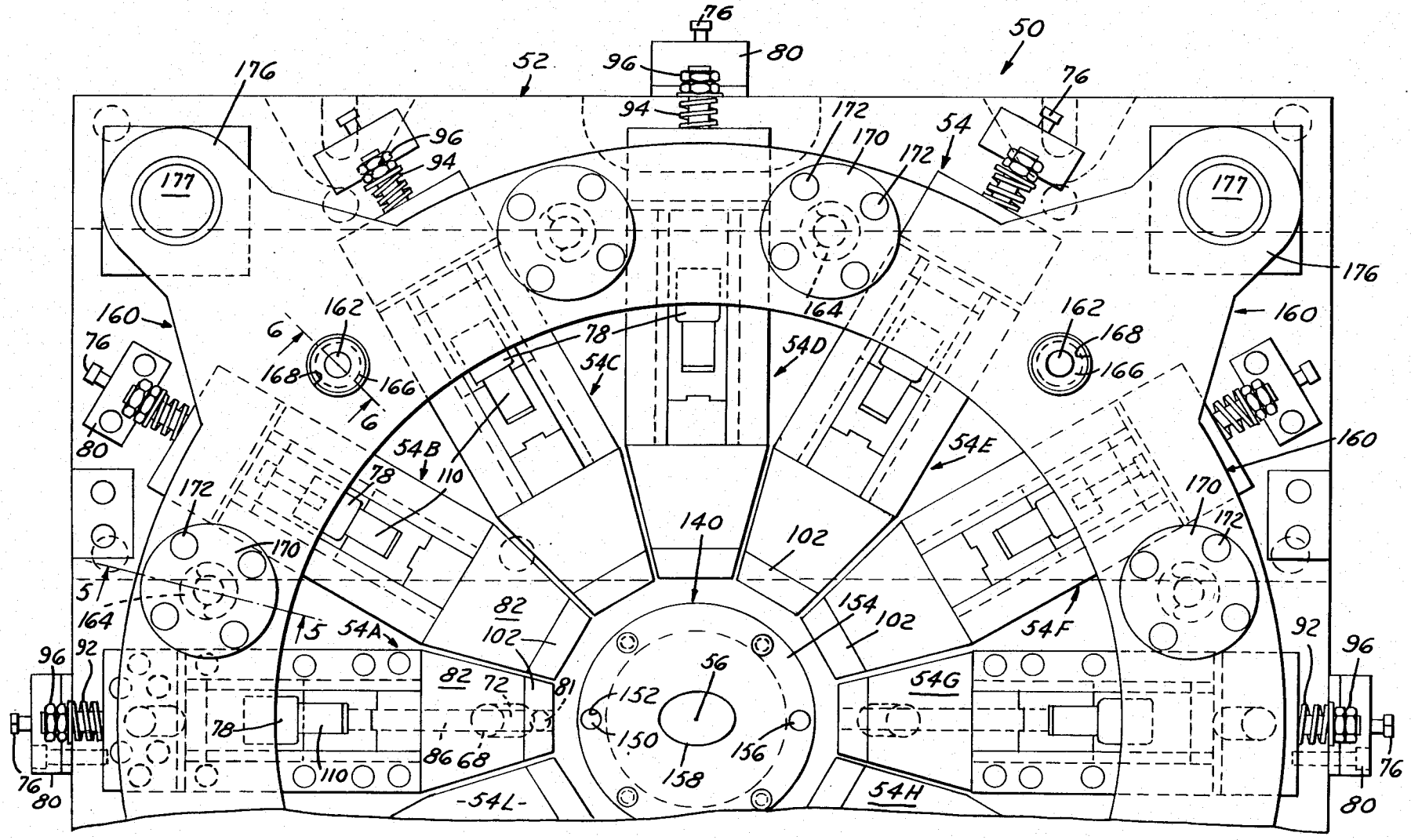
FIG. 4 is a fragmentary plan view of the lower portion of the apparatus of FIG. 3 with upper die holder 116 withdrawn—i.e. as viewed substantially along the line 4—4 in FIG. 8.
Figure 5:
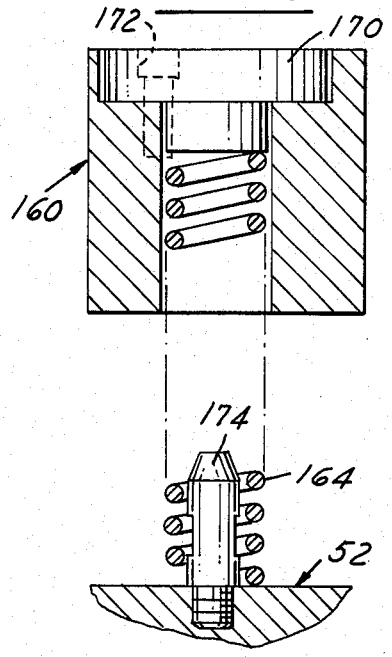
FIGS. 5 and 6 are fragmentary sectional views taken substantially along the lines 5—5 and 6—6 in FIG. 4.
Figure 6:
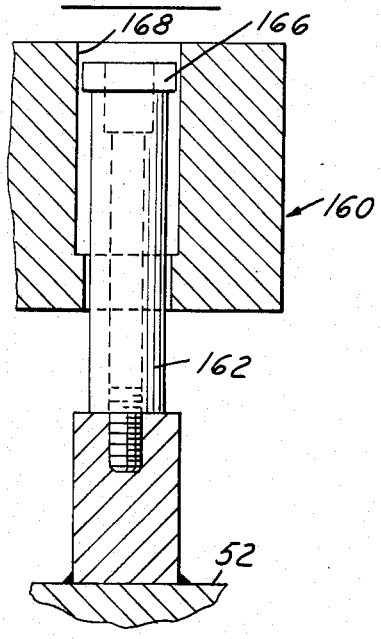

A circumferentially continuous actuator ring 160 (FIGS. 3-6)is slidably carried on the circumferentially spaced guide pins 162 (FIGS. 4 and 6) which are affixed to and project upwardly from support base 52, and is biased upwardly with respect to the support base by the circumferentially spaced coil springs 164 (FIGS. 4 to 5). Guide pins 162 each have an enlarged annular head 166 which cooperates with a counterhood guide pin opening 168 in ring 160 for limiting upward motion of ring 160 with respect to base 52. Each spring 164 is captured in compression between a spring cap 170 affixed to ring 160 by the bolts 172, and a spring locator pin 174 threaded into base 52 and projecting upwardly therefrom into the spring coils. A guide pin 166 is positioned between each pair of bead seat locators 54B, 54C, 54E,54F, 54H,54I and 54K,54L. A spring 164 is positioned between the remaining adjacent bead seat locator pairs. The arrays of springs 164 and pins 162 are concentric.

Orthogonally spaced fingers 176 (FIG. 4) integrally project outwardly from the body of ring 160 and slidably embrace corner guide posts 177 for additionally guiding motion of ring 160. Corner posts 177 are affixed to and project upwardly from base 52. Guide pins 162 are each aligned radially of axis 56 with a corresponding corner post 177. A plurality of circumferentially spaced actuator blocks 178 (FIGS. 3–4) are affixed by bolts 179 to and project radially inwardly from ring 160 in respective radial alignment with roller 110 on the several bead seat locators 54A–54L. Each block 178 has an angulated or ramped lower inside surface 180 (FIG. 3) for engaging a corresponding roller 110 and urging the associated bead seat locator section 82 radially inwardly during initial downward motion of ring 160, and a radially facing surface 182 for permitting additional downward motion of ring 160 without corresponding radial motion of bead seat locator sections 82 either inwardly or outwardly. An abutment ring 184 is affixed to and depends from upper die holder 116 for engagement of ring 160. Upper die holder 116 is apertured for sliding reception over corner guide posts 177.

Figure 9:
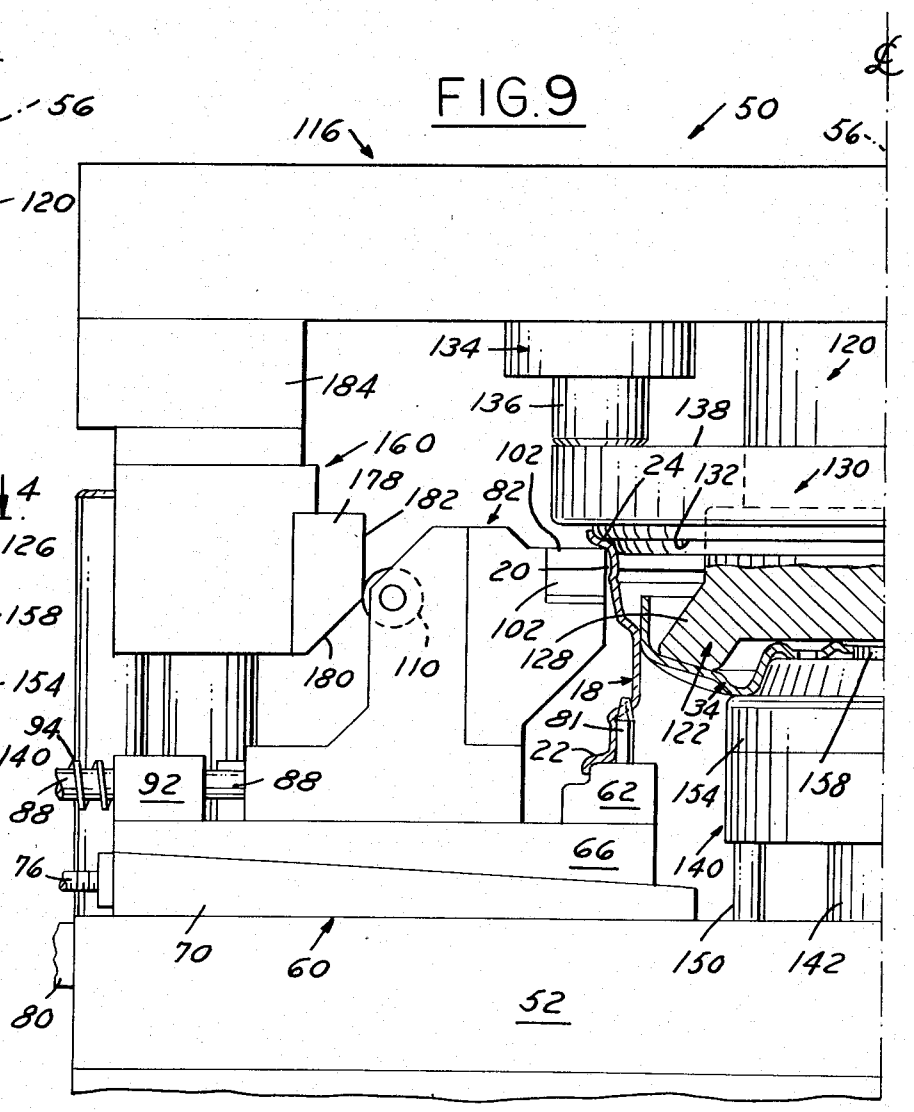
FIGS. 8–10 are fragmentary sectioned elevational views of the apparatus at respective successive stages of operation.
Figure 8:
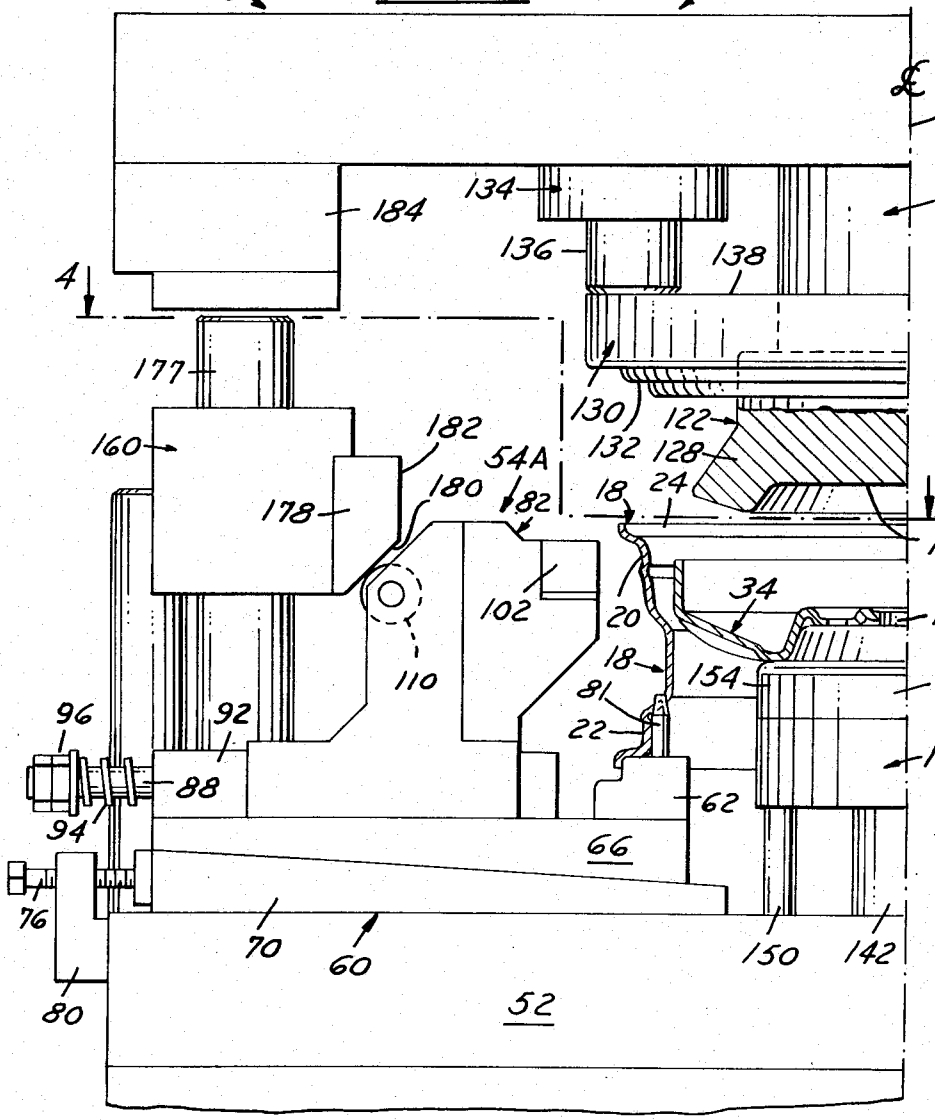
Figure 10:
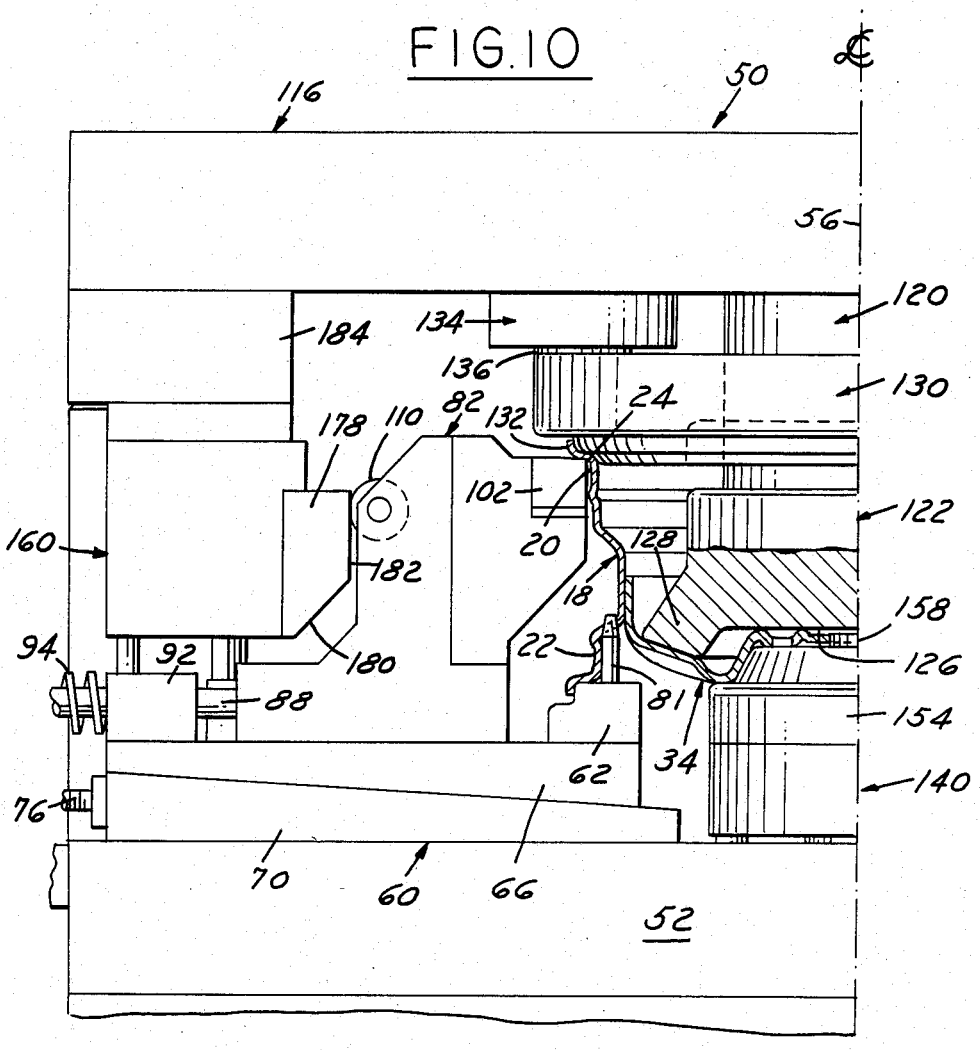

Successive stages of operation of apparatus 50 are illustrated in FIGS. 8–10. Initially, at a stage which precedes that illustrated in FIG. 8, upper die holder 116 is spaced a substantial distance from base 52 to permit insertion of the preformed rim and disc elements. At such initial stage of operation, actuator ring 160 is biased upwardly (FIG. 8) by springs 164 out of engagement with bead seat locator 54A–54L, and upper disc locator sections 82 are biased by springs 92 radially outwardly to their normal or retracted positions. Likewise, lower die head 140 is biased upwardly by spring 146. A preformed rim 18 is positioned on the several outboard bead seat locator pads 62, with pin 81 being received in the preformed rim valve hole for locating the rim circumferentially of press axis 56. A preformed disc 34 is then placed outboard face down upon the upper surface of lower die pressure plate 154, with hub 158 received in the preformed disc center opening. With the preformed rim and disc so located, upper die holder 116 is propelled by ram 118 to and through the position illustrated in FIG. 8 toward that illustrated in FIG. 9.

During such downward motion, ring 184 first abuts and then urges ring 160 downwardly against the collective force of springs 164, so that ramp surfaces 180 engage inboard bead seat locator rollers 110 and urge the several inboard bead seat locator sections 82 radially inwardly against the forces of associated springs 92. Continued downward motion of upper die holder 116 and ring 160 moves inboard bead seat locators 82 radially inwardly into engagement (FIG. 9) with inboard bead seat region 20, at which point rollers 110 engage surfaces 182 on blocks 178 so as to prevent further radially inward motion of the bead seat locators. At the same point in downward motion of upper die holder 116 or shortly thereafter (FIG. 9), surface 132 of ring 130, which is urged downwardly by hydraulic springs 134, engages inboard bead flange 24 and pressure plate 122 abuts the mounting surface of disc 34. Continued downward motion of upper die holder 116 from the position of FIG. 9 toward the final position in FIG. 10 forces lower die head 140 downwardly against the force of spring 146 (FIG. 3) so as to press disc 34 into rim 18. Preferably, the outer peripheral dimensions of disc flanges 36 and the inside diametric dimension of rim base 19 are such that such downward motion effects interference press-fit of the disc into the rim base. Continued downward motion of pressure ring 130 is arrested by abutment with inboard bead flange 24, which in turn is being supported by locator pads 102, so that hydraulic springs 134 are compressed. Thus, when upper die holder 116 is retracted from the position of FIG. 10 toward that of FIG. 9, upper die pressure plate 122, which is directly coupled thereto, moves out of engagement with disc 34. However, the wheel rim and disc assembly and lower die head 140 remain in the positions illustrated in FIG. 10 due to abutment of pressure ring 130 against the rim inboard flange 24. Continued upward motion of the upper die holder from the position of FIG. 9 to that of FIG. 8 disengages pressure ring 130 from the rim flange, whereby the wheel rim and disc assembly is lifted from pads 102,62 by spring 146 and lower die head 140. At the same time, inboard bead seat locator sections 82 are retracted by springs 92, so that the wheel and disc assembly may be removed from the assembly apparatus.

In accordance with one important feature of the present invention, the apparatus of the invention is initially set up for operation by assembling a number of rims and discs in the manner described, and then checking such rim and disc assemblies for lateral runout in the usual manner. Lower ramp blocks 70 of the several bead seat locators 54A–54L are empirically individually adjusted by means of associated studs 76 to selectively axially position the outboard bead seat pads 62, and inboard bead seat pads 102 are individually adjustably positioned radially and axially by selective use of appropriate shims 106,108 respectively, to obtain desired lateral runout characteristics. In one implementation of the invention, it is desirable to obtain minimum lateral runout—i.e. to approach an ideal "true running" wheel—by so positioning the bead seat locators that the average bead seat plane 32 (FIG. 2) is parallel to the plane 42 of the disc mounting surface. This is accomplished by adjusting the upper and lower bead seat locator sections until all locators contact the wheel rim when the press is closed. Opposed locator pairs are then simultaneously adjusted to reduce the harmonic of lateral runout, which is tested by making and checking a wheel after each adjustment. When minimum harmonic is obtained, the adjusted positions of the bead seat locators remains fixed for the given "run" of rims and discs. In the event that either the rim or the disc begins a fresh fabrication run prior to the assembly stage, the runout characteristics of the assembly must be rechecked, and the bead seat locators may require readjustment.

In another implementation of the invention, it is desirable to intentionally angulate the average bead seat plane 32 with respect to the mounting plane 42 by an amount and in a direction selected so as to place the peak to the first harmonic of lateral runout adjacent to a preselected circumferential location on the rim, such as adjacent to rim valve hole 38. This is accomplished by individual selective adjustment of inboard bead seat locator pads 62, using wedge blocks 66,70 and studs 76 as previously described, and by appropriate selection of shims 108. The upper and lower bead seat locator sections and opposed pairs of locators are first adjusted to obtain minimum lateral runout, in the manner previously described. The bead seat locators are then adjusted in adjacent pairs to move the harmonic peak circumferentially around the wheel. It will be noted, in this connection, that the upper and lower bead seat locator sections of each locator are not readjusted relative to each other during this procedure. That is, the separation between the inboard and outboard bead seat locator faces remains constant. When a wheel 18 having a first harmonic of lateral runout located adjacent to valve hole 38 is assembled to a tire 10 which is pretested to locate the complementary peak of the first harmonic of lateral force variation, which location is marked as at 14 (FIG. 1) on the tire sidewall, mark 14 is radially aligned with valve hole 38 so that the respective lateral first harmonics are out of phase and tend to cancel each other, thereby yielding a tire and wheel assembly having overall improved ride characteristics.

As previously indicated, it is presently envisioned that the subject matter of the present invention be combined—i.e. used in combination with—the subject matter of the previously referenced application and U.S. patents assigned to the assignee hereof to obtain a tire and wheel assembly having improved ride characteristics, in terms of both lateral and radial ride components. It has been found that lateral variations, due to lateral runout of the wheel and lateral force variation of the tire, do not contribute to undesirable ride characteristics as much as do radial runout and force variations, particularly when the lateral ride variations are held below a threshold level. It has also been found to be extremely difficult, employing present technology, to control both lateral and radial runout of a wheel, and lateral and radial force variations of a tire, so that both respective harmonics can be made to cancel. It is therefore presently preferred to construct a wheel to possess minimum lateral runout by locating the average bead seat plane 32 (FIG. 2) parallel to the wheel mounting plane 42 in accordance with the principles of the present invention, and to form the bolt and center-pilot openings in the wheel disc at a subsequent stage of manufacture so as to locate a peak of the first harmonic of radial runout adjacent to the valve hole, as described in the referenced application and patents.

The invention claimed is:

1. Apparatus for constructing a vehicle wheel assembly by pressing a preformed wheel disc having a disc periphery and an inboard disc surface which defines a wheel mounting plane into a preformed wheel rim having a rim base and a rim bead seat region including a rim flange, said apparatus comprising:

a support, a circumferential array of locating means on said support surrounding a central axis for selectively engaging and holding said bead seat region to define an average bead seat plane at predetermined orientation with respect to said axis, each of said locating means in said array including means for engaging said rim bead seat region from the direction of said axis and means for individually adjusting position of said engaging means in the direction of said axis with respect to said support and independently of the other said locating means, such that said engaging means collectively define orientation of said bead seat plane with respect to said axis, disc clamping means including means for engaging and holding a disc such that the mounting plane of said disc is perpendicular to said axis, and means for reciprocating said disc clamping means along said axis such that the periphery of a disc engaged and held by said clamping means is received by interference press-fit internally of the rim base of a wheel rim engaged and held by said engaging means.

2. The apparatus set forth in claim 1 wherein said means for individually adjusting position of said engaging means each comprise a pair of complementary wedge means, a first of each said wedge means being carried by said support and including means for moving said first wedge means radially of said axis, the second said wedge means of each said pair carrying the corresponding said engaging means and being positioned axially of said axis as a function position of said first wedge means radially of said axis.

3. The apparatus set forth in claim 2 for constructing a said vehicle wheel assembly from a rim having axially spaced inboard and outboard bead seat regions spaced from each other by said rim base, said circumferential array of locating means including means for engaging and holding both of inboard and outboard bead seat regions in the direction of said axis.

4. The apparatus set forth in claim 3 wherein said locating means comprises first locating means mounted in fixed position on each of said second wedge means for engaging one of said bead seat regions, and second locating means carried by each of said second wedge means for engaging the other of said bead seat regions.

5. The apparatus set forth in claim 4 further comprising means for selectively reciprocating said second locating means between a retracted position affording sufficient space for a rim to be placed on said first locating means and an engaged position radially inward of said retracted position wherein said second locating means engage said other of said regions.

6. The apparatus set forth in claim 5 further comprising means coupling said means for selectively reciprocating said second locating means to said means for reciprocating said disc clamping means, such that motion of said means for reciprocating said disc clamping means first causes engagement of said second locating means with said other bead seat region before press-fit engagement of said disc periphery with said rim base.

7. The apparatus set forth in claim 6 wherein said coupling means comprises roller-and-cam means associated with each of said locating means, and means normally biasing each of said second locating means to said retracted position.

8. The apparatus set forth in claim 6 wherein said locating means further comprises means for selectively adjusting position of each said second locating means with respect to the associated said first locating means in the direction of said axis.

* * * * *